US007043938B2

(12) United States Patent
Narayan et al.

(10) Patent No.: US 7,043,938 B2
(45) Date of Patent: May 16, 2006

(54) METHOD OF THAWING A CRYOGENIC UNIT

(75) Inventors: Raghu S. Narayan, Conroe, TX (US); Steven T. Coleman, Humble, TX (US); James H. Walker, Crosby, TX (US)

(73) Assignee: Equistar Chemicals, LP, Houston, TX (US)

( * ) Notice: Subject to any disclaimer, the term of this patent is extended or adjusted under 35 U.S.C. 154(b) by 764 days.

(21) Appl. No.: 10/235,591

(22) Filed: Sep. 5, 2002

(65) Prior Publication Data

US 2004/0055330 A1 Mar. 25, 2004

(51) Int. Cl.
*F25D 21/00* (2006.01)
*F25J 5/00* (2006.01)
*F28G 9/00* (2006.01)

(52) U.S. Cl. ..... 62/625; 62/81; 62/282; 62/620; 62/630; 62/632; 165/95

(58) Field of Classification Search ..... 62/50.2, 62/51.1, 81, 282, 620, 625, 632, 920, 934; 165/95; 585/648, 650
See application file for complete search history.

(56) References Cited

U.S. PATENT DOCUMENTS 5,456,084 A * 10/1995 Lee ..... 62/51.1
5,730,209 A * 3/1998 Sunder et al. ..... 165/95
5,921,092 A * 7/1999 Behr et al. ..... 62/81
5,937,656 A * 8/1999 Cheng et al. ..... 62/50.2

* cited by examiner

*Primary Examiner*—Walter D. Griffin
*Assistant Examiner*—Prem C. Singh
(74) *Attorney, Agent, or Firm*—Roderick W. MacDonald

(57) ABSTRACT

A method for thawing and removing frozen material from a cryogenic separation unit such as that found in an olefin production plant comprising employing a flushing agent to thaw and remove the frozen material, purging the flushing agent with a gas, and removing residual flushing agent with a solvent that is miscible with the flushing agent and has a freezing temperature substantially lower than the flushing agent.

17 Claims, No Drawings

METHOD OF THAWING A CRYOGENIC UNIT

BACKGROUND OF THE INVENTION

1. Field of the Invention

This invention relates to removing frozen material from a cryogenic separation unit without shutting down that unit. In particular, this invention relates to the production of olefins by thermal cracking a hydrocarbon containing feed and separating from said cracked feed a high purity molecular to hydrogen stream by use of at least one cryogenic unit (hereinafter sometimes "cold box" or "unit"). More particularly, this invention relates to thawing and removing frozen material in said unit without shutting down the olefin production plant as a whole, with minimal loss of production from said plant, and with favorable environmental impact results.

2. Description of the Prior Art

Although this invention has broader application, it will, for the sake of clarity and brevity, be described in its application to an olefin production plant.

Thermal cracking is a petrochemical process that is widely used to produce olefins such as ethylene, propylene, butenes, and butadiene, and aromatics such as benzene, toluene, and xylenes.

Basically, the hydrocarbon containing feed, for example, naphtha, vacuum gas oil, natural gas condensate, or other liquid hydrocarbons at ambient temperature and pressure, is mixed with steam which serves as a diluent to keep hydrocarbon molecules separated, and the steam/hydrocarbon mixture is subjected to an elevated temperature of from about 1400° F. to about 1500° F. at from about 15 to about 25 psig in a pyrolysis furnace (steam cracker). The cracked feed contains gaseous hydrocarbons of great variety, e.g., from one to thirty-five carbon atoms per molecule. Such hydrocarbons can be saturated, monounsaturated, and polyunsaturated, and can be aliphatic, and/or aromatic. The cracked feed also contains significant amounts of molecular hydrogen formed by the well-known free radical mechanism as saturated molecules such as ethane are converted during cracking into unsaturated molecules such as ethylene thereby freeing hydrogen radicals. Hydrogen radicals thus formed during cracking collide with one another to form a stable hydrogen molecule. Thus, the original feed, even if it initially contained molecular hydrogen, hereinafter "hydrogen" unless otherwise stated, is substantially enhanced in hydrogen content. This enhanced hydrogen content in the cracked feed is desirably separated from the hydrocarbon products also present.

Thus, thermal (steam) cracking is a noncatalytic process that employs diluent steam which does not participate chemically in the process as it does in steam reforming. The pyrolysis (cracked) product can contain, for example, based on the total weight ("wt.") of the product, about 2 wt. % hydrogen, about 10 wt. % methane, about 25 wt. % ethylene, and about 17 wt. % propylene, with the remainder being a very wide variety of other hydrocarbon molecules from four carbon atoms per molecule down to a tar like material that contains hydrocarbon molecules having from 30 to 35 carbon atoms per molecule. But this is not all that is contained in the cracked feed product.

Because the thermal cracking process is so robust, it can handle a very wide chemical range of feedstock compositions. This allows for broad feedstock specifications for cracking operations. Because such feedstock specifications are not as tight as other processing units, for example, a hydrotreater, cracking processes are more likely to have chemical impurities in their feedstocks. For example, sulfur containing compounds and nitrogen bearing compounds like ethanolamine can often be present in thermal cracking feedstocks. The sulfur bearing compounds pose no particular problem in processes normally employed on the product effluent of the cracking process. For example, conventional caustic washing, which often is employed in such subsequent processes, readily removes sulfur compounds. On the other hand, nitrogen bearing compounds often break down under thermal cracking conditions to yield materials such as ammonia and various nitrogen oxides. Unfortunately, these materials separate out in subsequent processing by freezing solid in cryogenic units.

In order to separate a high purity hydrogen stream product, e.g., at least about 95 wt. % hydrogen, from said cracked feed, cryogenic units that can operate at temperatures below −240° F. are employed. Such units essentially liquefy the cracked feed except for hydrogen and some methane, and sometimes some ethylene and propylene. These cryogenic units are normally multiple pass heat exchangers that are well known in the art and contain a plurality of individual heat exchange sections that are physically close to one another if not contiguous, but operate independently of one another. Different fluid streams at differing temperatures flow through discrete and physically separate sections of a single unit at the same time, the result being that after the cracked feed and/or various fractions thereof have passed through one or more sections of said unit at one or more temperatures varying from about 80° F. down to about −270° F., the desired high purity hydrogen stream is achieved and ready for separation from said plant as a valuable product thereof. This hydrogen product is rich in hydrogen, but, depending upon various factors such as its operating efficiency, can still contain small amounts of light hydrocarbon, e.g., methane. The less hydrocarbon in the hydrogen stream product the better for obvious commercial reasons.

However, multiple pass heat exchangers (hereinafter referred to from time to time as a "unit"), with their high heat exchange capacity, have very small internal clearances, e.g., 2 millimeters, for the various streams passing through various sections thereof to be cooled or heated as the case may be.

Since such units operate at very low temperatures with very narrow clearances, it is vital to keep the clearances free of obstructions in order that the unit operates at its peak efficiency. Should the operating efficiency of such a unit degrade, even to a slight extent, the purity of the various product streams of the olefin plant can deteriorate. For example, should one or more sections in the unit experience the formation of frozen material (rime) in their internal passageways (cryogenic fouling), the result can be the invasion of increasing amounts of undesired light hydrocarbon, even ethylene and propylene, into the high purity hydrogen product of the plant. This decreases the commercial value of that product.

The various sections of the unit operate at different temperatures depending upon what stream is passing through a particular section. For example, one section of a unit could be operating at an Inlet temperature of −35° F. and outlet temperature of −50° F., while a nearby or contiguous section is operating at an inlet temperature of −147° F. and outlet temperature of −103° F., while yet another nearby or contiguous section in the unit is operating at an inlet temperature of −147° F. and an outlet temperature of −204° F. Thus, it can be seen that a specific stream containing materials having various freeze points may pass through one or more sections of the unit without forming a rime, but then may encounter a separate section that is operating at a lower temperature than the other section(s), and rime could form in that section thus adversely affecting the overall heat transfer efficiency of the unit and the quality of its various outflow streams.

As aforesaid, nitrogen containing compounds can be present in streams that are passing through the various sections of the unit. Unfortunately, a number of these compounds have freezing points (temperatures) within the operating temperature range of the overall unit. For example, nitrogen dioxide freezes at 12° F., ammonia freezes at −108° F., nitrogen trioxide freezes at −152° F., and nitric oxide freezes at −264° F. Accordingly, nitrogen containing compounds are a prevalent source of cryogenic fouling.

Heretofore, when a unit has experienced cryogenic fouling, the entire olefin plant has been shut down, and the entire unit defrosted to melt the rime. This can require disposal, e.g., flaring, of the entire feed to the plant.

It is desirable to keep the plant and unit operating while thawing and removing the offending rime from the section(s) of the unit that is afflicted with cryogenic fouling. This approach minimizes the adverse productivity impact on the plant. In addition, this approach minimizes possible environmental impact that may be necessary during shutdown for thawing.

By this invention, a unit is derimed in only the section(s) experiencing cryogenic rime fouling while leaving the plant and other sections of the unit operating at or at least near their normal conditions.

Thus, by the practice of this invention, a unit is derimed in a fraction of the time it would take to thaw the entire unit, with minimal loss of plant production, and with favorable environmental results.

SUMMARY OF THE INVENTION

In accordance with this invention, there is provided a method for deriming a multi-section cryogenic unit without shutting down said unit comprising introducing into each cryogenically fouled section of said unit at least one liquid flushing agent that has a freezing temperature below the operating temperature of said each section, the flushing agent being at a temperature sufficient to melt or dissolve the rime that is present, removing melted or dissolved rime and flushing agent from the section and unit, terminating the flushing leaving flushing agent in the section, introducing into the thawed section at least one purge gas to remove part of the remaining flushing agent from the section and unit, the purge gas having a temperature of vaporization such that it will not condense to liquid at the temperature of the section after said flushing, terminating said purging, introducing into the purged section at least one liquid solvent that is miscible with the flushing agent, the solvent having a freezing temperature below the operating temperature of said unit, and removing from the section and unit a solvent/flushing agent mixture thereby leaving primarily only solvent in the thawed section(s).

DETAILED DESCRIPTION OF THE INVENTION

Multiple pass heat exchangers are well known in the art. A particularly useful type of such heat exchanger is the brazed aluminum plate-fin exchanger that has been in wide use for the past 50 years and is used extensively for cryogenic separations. Tens of thousands of this type of heat exchanger are in use worldwide. For sake of brevity, this invention will be described with respect to a plate-fin exchanger, but it should be understood that this invention applies to any type of multiple pass heat exchanger. A plate-fin exchanger has considerably more surface area density than, for example, a shell-and-tube exchanger thereby allowing a reduced temperature approach and lower operating costs. Its design is such that many process streams can be combined into a single unit which provides a mechanism to combine services and provide an optimized heat exchanger network.

Plate-fin exchangers are composed of a core block constructed of alternating layers of corrugated sheets (fins) and flat parting sheets. Each layer is bound by bars and provided with inlet and outlet distributors and ports. Headers and nozzles are attached to the bars covering the distributors and ports. Multiple shell-and-tube exchangers can be combined into a single plate-fin exchanger unit.

In operation, a stream (one of many) enters the exchanger through a nozzle and header and is introduced to the exchanger block at the port. After flowing through the port, the stream is directed across the width of the exchanger by way of a distributor fin and enters the heat transfer fin section. The stream flows through the heat transfer fin, and then out through the outlet distributor fin, port, header, and nozzle. This type of exchanger allows for a wide variety of design configurations. The flow design can be counter flow, cross-flow, cross-counter flow, and the like. This type of heat exchanger can handle many phases of fluids (gas-to-gas, gas-to-liquid, two phase, and combinations thereof in series or parallel, allowing multistream configurations with up to 15 different streams being treated by a single cryogenic unit. Some plate-fin designs operate like kettle-type shell and tube exchangers. When many units are needed, they can be packaged in a steel cold box that provides structural support, interconnecting piping and insulation. In an olefin plant, the cryogenic separation unit is often referred to as the "cold box."

When used in an olefin plant, the cryogenic unit or cold box is generally employed downstream of the pyrolysis (cracking), quench, and compression operations. The cracked and compressed feed is then subjected to a caustic wash to remove acidic components such as carbon dioxide, hydrogen sulfide, mercaptans, etc., removal of some three- to five-carbon atom hydrocarbons, and removal of water before being introduced into the cold box. Olefin plants vary in their exact processing steps. The foregoing is a general description of a plant operation, and although the exact steps of other olefin plants may vary from the foregoing, this invention will apply to any plant or other facility that employs a multiple pass heat exchanger that is subject to cryogenic fouling.

In the case of one particular olefin plant configuration, the unit (cold box) in general operates in conjunction with a demethanizer, the unit exchanging a plurality of streams with the demethanizer, the streams varying in temperature from −53° F. to −270° F. During this exchange, essentially all of the hydrocarbons are liquefied except for slight amounts of methane, and sometimes ethylene and/or propylene. The hydrogen present in the cracked feed remains gaseous and at various successive stages of cooling in the unit liquefied hydrocarbons are removed from the unit to the demethanizer. Thus, the overall concentration of hydrogen increases and the concentration of hydrocarbons decreases. For example, four separate streams containing liquefied hydrocarbons can be removed to the demethanizer at four different and lower temperatures of −102° F., −130° F., −151° F., and −220° F. After removal of a liquified fuel gas supply stream at −267° F., the remaining material is essentially the desired dry high purity hydrogen stream containing 5 wt. % or less hydrocarbons, based on the total weight of the stream. It can be seen that the unit receives a plurality of streams for heat exchange in a plurality of sections of the unit. Thus, each section of the unit is operating at a different temperature, and, depending upon the freezing temperature of the compounds in the cracked feed in that particular section of the unit in relation to the operating temperature of that section at that time, one or more of those compounds can freeze and plate out or otherwise deposit on an interior surface of that section. This can cause a buildup of frozen material in that particular unit section which, after a time, can, due to the very narrow clearances in a multiple pass unit, build up sufficiently to increase the pressure drop across that section and degrade the heat exchange efficiency thereby allowing, for example, more methane to stay with the hydrogen stream product than is desired. This frozen material or rime must be melted and removed from the unit to restore the plant to its optimum efficiency and optimum hydrogen product purity.

In an olefin plant, nitrogen containing compounds often cause cryogenic fouling by frozen material depositing in a unit as aforesaid since the more prevalent compounds (ammonia, nitric oxide, nitrogen dioxide, and nitrogen trioxide) freeze in the range of 12° F. to −264° F.

In accordance with one aspect of this invention, cryogenic fouling is removed from a cold box unit in an olefin plant without shutting down the plant or unit by continuing plant and unit operation while flushing only the fouled section(s) of the unit to thawing and remove the frozen material. The hydrocarbon feed to only the fouled section(s) is diverted within the plant and otherwise disposed of such as by flaring as opposed to diverting the hydrocarbon feed to the plant as a whole should the entire cold box be shut down for thawing.

The thawing and removal step is carried out using at least one flushing liquid, at least one time, this agent 1) having a freezing temperature below the operating temperature of the section being thawed, 2) having good solubility for the aforesaid nitrogen containing compounds, 3) being hygroscopic for absorption of residual water, and 4) having a viscosity such that it will flow through the narrow clearances of the section, even when narrowed further by rime deposits, at the operating temperature of that section. The flushing agent is preferably introduced into the section to be thawed at the ambient atmospheric temperature prevailing outside the unit; although, it can be at any temperature that achieves the desired thawing. The flushing agent preferably has a freezing temperature at least about 15° F. below the operating temperature of the at least one section to be thawed, and preferably a freezing point below −130° F. Suitable flushing agents are methanol, ethanol, allyl alcohol, 1-propanol, and mixtures of two or more thereof.

The flushing agent can melt the frozen material and remove it from the section sequentially, concurrently, and the like, the desired result being removal of the rime without raising the temperature of adjacent sections unduly so that restart of the unit as a whole is short. If the whole plant was to be shut down to warm up and thaw the entire unit, restart and cool down to operating temperatures would take days.

When flushing is terminated, the treated section(s) contains flushing agent which is removed in part by purging the section at least one time with at least one gas. The purge gas will force a substantial amount of flushing agent out of the section(s) and unit but still leave enough flushing agent that it could cause new rime fouling elsewhere should it reach other, colder sections of the unit. The purge gas should have a vaporization temperature such that it will not condense to liquid at the temperature of the section(s) after flushing. The purge gas can be introduced into the section(s) at any temperature, e.g., ambient temperature as defined above. Suitable purge gases include nitrogen, methane, hydrogen, and mixtures of two or more thereof.

The flushing agent left in the thawed section(s) after purging is removed by introducing at least one time into said section(s) at least one solvent which is miscible with the flushing agent. What is meant by "miscible" is the solvent is capable of mixing with the flushing agent in any ratio without separation into a solvent phase and a separate flushing agent phase. The solvent should 1) have a high miscibility with the flushing agent present in the section(s), 2) have a freezing temperature substantially lower than said flushing agent, preferably a freeze point below −200° F., and 3) have a viscosity such that it will flow through the section(s) at the operating temperature of the section(s), preferably at the lowest operating temperature of the unit.

A suitable solvent can be chosen for a particular flushing agent by using the well-known Hansen solubility parameter, defined as "the square root of the cohesive energy density," in conjunction with other known liquid properties such as hydrogen bonding, etc. This parameter can be used as an "a priori" indicator of mutual solubility between flushing agent and solvent. Using published information on solubility parameters, one skilled in the art can determine the general affinity of a specific pair of solvents and flushing agents.

Suitable specific solvents for the specific flushing agents listed hereinabove include propylene, propane, ethane, and ethylene, and mixtures of two or more thereof. The solvent can be a liquid or gas, preferably a liquid. Solvent injection is employed to remove essentially all flushing agent from the section(s). A mixture of solvent and flushing agent is removed from the unit leaving primarily only solvent in the thawed section(s).

The thawed section(s) is then restarted and brought down to its normal operating temperature in short time since the remainder of the unit was not thawed or substantially warmed by the relatively localized thawing of this invention. In this way, the overall unit is restored to its normal operating temperatures and efficiency without shutting down the entire unit, with minimal loss of plant production, and with minimal shutdown and start-up flaring.

EXAMPLE 1 (PRIOR ART)

In a section of the cold box in the olefin plant described hereinabove, a buildup of frozen material was indicated by an increasing pressure drop across that section. The frozen material was shown to be composed of frozen nitrogen containing compounds, primarily a plurality of differing nitrogen oxides.

The cold box as a whole was continued in its normal operation except for the fouled section containing frozen material. Normal feed gas flow to the fouled section was terminated and that gas was flared until restart of the section. In place of the feed gas, methanol (−140° F. freeze point) was introduced into the fouled section at ambient temperature of about 80° F. to thaw the frozen material and to remove same from the section and unit. Flushing agent was removed at −100° F. The section was restarted. Within 24 hours evidence of cryogenic fouling occurred again. The frozen material causing this second fouling was found to be methanol. Methanol has a great affinity for nitrogen containing compounds, but being a polar molecule with its particular surface tension characteristics, it is difficult to remove. This invention accomplishes reliable removal of solvents such as methanol.

EXAMPLE 2

The methanol flush of a fouled cold box section, as set forth in Example 1, was repeated except that after the methanol flush to thaw and remove thawed nitrogen containing compounds from the fouled section and the unit, the flushing step was followed by a nitrogen gas purge. The nitrogen gas was introduced at ambient temperature of about 80° F. and removed at about −100° F. A significant amount of methanol was left in the section after purging. After termination of the purge step, propylene (−301° F. freeze point) at ambient temperature of about 80° F. was introduced into the section and a mixture of methanol and propylene removed at about −100° F. from the section and unit until essentially only propylene was left in the thawed section. Feed gas flaring was terminated and feed gas reintroduced into the section. No further fouling was experienced in the unit. Propylene, with its great affinity for methanol and much lower freezing point, solved the methanol fouling follow on.

While solving present and possible future fouling problems, the practice of this invention, as set forth in this Example, allowed the unit to be operating at close to its normal operating conditions. In other words the unit, particularly in sections adjacent or otherwise nearby the fouled section being thawed and flushed with ambient temperature fluids, was kept from getting too warm due to their continued operation, and was kept cold enough so that restart time for the thawed section and the unit as a whole was very short (hours) compared to shut down of the whole system and thawing of the cold box as a whole (days).

We claim:

1. A method for removing frozen material from at least one section of a multiple section cryogenic unit without shutting down said unit comprising introducing at least one flushing agent at least one time into said at least one section to melt said frozen material, said flushing agent being a liquid with a freezing temperature below the operating temperature of said at least one section, said flushing agent being at a temperature sufficient to melt said frozen material and remove same from said at least one section, introducing at least once at least one purge gas to remove part of said flushing agent, said purge gas having a temperature of vaporization such that it will not condense to liquid at the temperature of said at least one section after flushing, and introducing at least one time into said at least one section at least one solvent that is miscible with said flushing agent, said solvent having a freezing temperature below the operating temperature of said at least one section.

2. In the operation of an olefin production plant wherein a hydrocarbon containing feed is thermally cracked to form at least one olefin and molecular hydrogen, and a high purity molecular hydrogen stream is separated from said cracked feed by way of a multi-sectioned cryogenic unit, said unit from time to time experiencing reduced efficiency from its normal operating efficiency due to cryogenic fouling in at least one section thereof, said fouling being caused by the formation of frozen material in at least a portion of said at least one section, the improvement comprising continuing the operation of said olefin plant and said unit, discontinuing the operation of said at least one section, melting and/or dissolving and removing said frozen material from said at least one section by flushing said at least one section at least once with at least one liquid flushing agent that has a freezing temperature below the operating temperature of said at least one section, said flushing agent being at a temperature sufficiently elevated to melt said frozen material, removing said melted frozen material and flushing agent from said at least one section and unit during said flushing, terminating said flushing leaving flushing agent in said at least one section, introducing at least one time into said at least one section at least one purge gas to remove part of said flushing agent that remains in said at least one section, said purge gas having a temperature of vaporization such that it will not condense to liquid at the temperature of said at least one section after said flushing operation, terminating said purging, introducing at least one time into said at least one section at least one solvent that is miscible with said flushing agent, said solvent having a freezing temperature at least below the operating temperature of said section, removing a solvent and flushing agent mixture from said at least one section and unit leaving primarily only solvent in said at least one section and unit, and restarting the operation of said at least one section, whereby said unit is restored to its normal operating efficiency without shutting down the operation of the entire unit and with minimal loss of olefin plant production while melting and removing said frozen material.

3. The method of claim 1 wherein said cryogenic unit is a multiple pass heat exchanger.

4. The method of claim 2 wherein said high purity molecular hydrogen stream consists essentially of hydrogen with minor amounts of at least one of methane, ethylene, and propylene.

5. The method of claim 1 wherein said unit sections operate at varying temperatures in the range of from about 80° F. to about −270° F.

6. The method of claim 2 wherein said frozen material consists essentially of at least one nitrogen containing compound.

7. The method of claim 6 wherein said frozen material is at least one compound selected from the group consisting of ammonia, nitric oxide, nitrogen dioxide, and nitrogen trioxide.

8. The method of claim 1 wherein said flushing agent has a freezing temperature at least about 15° F. below the operating temperature of said at least one section.

9. The method of claim 1 wherein said flushing agent is introduced into said at least one section at about ambient temperature.

10. The method of claim 6 wherein said flushing agent is a solvent for said at least one nitrogen containing compound, has a freezing temperature below −130° F., is hygroscopic, and has a viscosity such that it will flow through said at least one section at the normal operating temperature of said at least one section.

11. The method of claim 1 wherein said flushing agent is at least one compound selected from the group consisting of methanol, ethanol, allyl alcohol, and 1-propanol.

12. The method of claim 1 wherein said thawing and removing of said frozen material occurs sequentially, concurrently, or a combination thereof.

13. The method of claim 1 wherein said purge gas is at least one material selected from the group consisting of nitrogen, methane, and hydrogen.

14. The method of claim 1 wherein said purge gas is introduced into said unit at ambient temperature.

15. The method of claim 1 wherein said solvent (1) is capable of mixing with said flushing agent in any ratio without separation into a solvent phase and a separate flushing agent phase, (2) has a freezing point below about −200° F., and (3) has a viscosity such that it will flow through said at least one section at the operating temperature of said at least one section.

16. The method of claim 1 wherein said solvent is at least one material selected from the group consisting of propylene, propane, ethane, and ethylene.

17. The method of claim 7 wherein said flushing agent is methanol, said purge gas is nitrogen, said solvent is propylene, and each is introduced into said at least one section at about ambient temperature.

* * * * *